United States Patent [19]

Tsukuda et al.

[11] Patent Number: 4,866,479

[45] Date of Patent: Sep. 12, 1989

[54] PHOTOSENSITIVE DRUMS

[75] Inventors: Ichizo Tsukuda, Kishiwadashi; Takashi Atsumi, Kawachinaganoshi; Masao Yokoyama, Oyamashi, all of Japan

[73] Assignee: Showa Aluminum Kabushiki Kaisha, Osaka, Japan

[21] Appl. No.: 198,173

[22] Filed: May 24, 1988

[30] Foreign Application Priority Data

May 29, 1987 [JP] Japan ..... 62-137549

[51] Int. Cl.[4] ..... G03G 15/00

[52] U.S. Cl. ..... 355/211; 355/202; 346/160; 420/550; 430/56; 430/69

[58] Field of Search ..... 355/200, 202, 211, 213; 346/160, 153.1, 762; 420/528, 529, 540, 542, 547, 548, 550, 551; 430/69, 119, 135, 63, 62, 56

[56] References Cited

U.S. PATENT DOCUMENTS

| | | | |
|---|---|---|---|
| 4,258,113 | 3/1981 | Kuehnle | 430/135 X |
| 4,292,386 | 9/1981 | Takano | 430/63 |
| 4,296,422 | 10/1981 | Kawaziri et al. | 355/211 X |
| 4,340,296 | 7/1982 | Ohara et al. | 355/211 |
| 4,551,406 | 11/1985 | Schaedlich et al. | 430/119 |
| 4,601,963 | 7/1986 | Takahashi et al. | 430/69 |

*Primary Examiner*—A. C. Prescott

[57] ABSTRACT

A photosensitive drum adapted for use in electronic copying machines and laser beam printers, the drum made of aluminum-based alloy and supporting a photosensitive recepter thereon, the aluminum-based alloy having a composition consisting essentially of 0.5 to 8.0% of Ni, and preferably, one or more additives selected from a group of 0.05 to 1.5% of Mn, 0.05 to 1.0% of Cr, 0.05 to 0.5% of Zr, 0.5% or less of Ti, 0.1% or less of B, 0.05 to 7.0% of Cu, 0.05 to 7.0% of Mg, 0.05 to 8.0% of Zn, 0.05 to 12.0% of Si, and 0.05 to 2.0% of Fe, and the balance being substantially aluminum.

8 Claims, No Drawings

PHOTOSENSITIVE DRUMS

The present invention relates to a photosensitive drum adapted for use in electronic copying machines and laser beam printers, and more particularly to a drum made of aluminum-based alloy and having a photosensitive receptor placed thereon such as selenium or any other organic photo-sensitive substances. The percentages used in this specification are all represented by weight unless specified to the contrary.

In order that this kind of drums may have an excellent reproductivity of images, they must have constant electric characteristics assessed by secular changes in the surface potential and dark attenuation over a period of use. It has been discovered that the electric characteristics depends not only on the quality of photosensitive layer placed on the drums but also on the material of which the drums are made.

Based upon this discovery there have been proposed various kinds of material for making the drums; for example, Japanese Patent Publication (examined) No. 51-35550 discloses the use of pure aluminum, Al-Mn alloys or Al-Mg alloys for making drums.

These materials may be conducive to enhance the surface potential and dark attenuation at the initial stage but the drums made of them are found to be period of use. This is of particular disadvantage when many prints are to be produced over a relatively long period of time. The representation of images are likely to become less sharp as time goes.

The present invention aims at solving the problems pointed out with respect to the known drums discussed above. Thus an object of the present invention is to provide a drum capable of constant sharp representation of images over a period of use.

Another object of the present invention is to provide a drum having sufficient mechanical strength and enhanced electric characteristics.

Other objects and advantages of the present invention will become more apparent from the following detailed description, when taken in conjunction with an example which shows, for the purpose of illustration only, one embodiment in accordance with the present invention.

According to one aspect of the present invention there is provided a drum made of aluminum-based alloy having a composition consisting essentially of of 0.5 to 8.0% of Ni, the balance being substantially aluminum.

According to another aspect of the present invention there is provided a drum made of aluminum-based alloy having a composition consisting essentially of of 0.5 to 8.0% of Ni, and one or more additives selected from a group of 0.05 to 1.5% of Mn, 0.05 to 1.0% of Cr, 0.05 to 0.5% of Zr, 0.5% or less of Ti, 0.1% or less of B, 0.05 to 7.0% of Cu, 0.05 to 7.0% of Mg, 0.05 to 8.0% of Zn, 0.05 to 12.0% of Si, and 0.05 to 2.0% of Fe, and the balance substantially aluminum.

Now, the invention will be more particularly described:

Nickel (Ni) is added to improve the electric characteristics of a drum, specifically, to minimize secular changes (changes with time) in its surface potential and dark attenuation, thereby maintaining the initial good performances thereof. However if the content of Ni is less than 0.5% no effect results. However if it exceeds 8.0%, the electric characteristics will become degenerated. A preferred range is 1.5 to 6.0%.

One or more additives selected from a group of Manganese (Mn), Chrome (Cr), Zirconium (Zr), Titanium (Ti), Boron (B), Copper (Cu), Magnesium (Mg), Zinc (Zn), Silicon (Si), and Iron (Fe) are added to improve the mechanical properties of the drum without negating the electric characteristics improved by the addition of Ni. More specifically, Mn, Cr and Zr are conducive to produce fine crystals of the material alloy, Ti and B are effective to prevent the forming drums from cracking in the mold, and Cu, Mg, Zn, Si and Fe can increase the mechanical strength of the drums. Si and Fe are also conducive to increase the workability of the material alloy for fabricating drums. However, the quantities of these additives are individually required to fall in specific ranges:

If the contents of Mn, Cr, and Zr are respectively less than 0.05%, and/or if Ti and B are not present, no substantial effect results. Likewise, if the contents of Cu, Mg, Zn, Si and Fe are respectively less than 0.05%, no substantial effect results. However the addition of an excessive amount does not mean that the expected effects are multiplied, but in fact the resulting effects remain the same; that is, if the contents of Mn, Cr, Zr, Ti, B, Cu, Mg, Zn, Si and Fe exceed 1.5%, 1.0%, 0.5%, 0.5%, 0.1%, 7.0%, 7.0%, 8.0%, 12.0% and 2.0%, respectively, no increased effect cannot be expected. What is worse, an excessive addition is likely to cause cracks during the molding process. Any crack makes the surface of the drum uneven. The uneven surface impairs the electric characteristics of the drum. Preferably, the contents of Mn, Cr, Zr, Cu, Mg, Zn, Si, and Fe are in the range of 0.1 to 1.5%, 0.1 to 1.0%, 0.1 to 0.5%, 0.1 to 2.0%, 0.1 to 2.0%, 0.1 to 3.0%, 0.1 to 3.0% and 0.1 to 1.5%, respectively.

The drum per se is produced in a known manner, and no special process is required. For example, one process (commonly called EI process) is to extrude a material alloy and mold into pipes, whose surfaces are machined to form drums. Another process (called ED process) is to extrude a material alloy and mold into pipes, which are shaped into drums by drawing. A further process (commonly called DI process) is to roll a material alloy into a sheet, and draw blank drums therefrom. Then the blank drums are swaged into finished drums having a desired diameter.

In use, the drums are covered with a photosensitive receptor such as a selenium layer or any other photosensitive layer, wherein the coating process per se is carried out in a known manner.

Since the drums of the present invention is made of aluminum-based alloy containing Ni in a small but effective amount, the electric characteristics is enhanced so that the initial performances of surface potential and dark attenuation are maintained over a period of use. This ensures that the drums can constantly produce a sharp representation of images.

EXAMPLE

This example illustrates how the drums in accordance with the present invention are different from those made of a material having different composition with respect to the secular changes in the surface potential and dark attenuation:

TABLE 1

| Alloy No. | Composition (wt %) | | | | | | | | | | | |
|---|---|---|---|---|---|---|---|---|---|---|---|---|
| | Ni | Mn | Cr | Zr | Ti | B | Cu | Mg | Zn | Si | Fe | Al |
| Invention | | | | | | | | | | | | |
| 1 | 0.80 | — | — | — | — | — | — | — | — | — | — | bal. |
| 2 | 5.24 | — | — | — | — | — | — | — | — | — | — | bal. |
| 3 | 7.78 | — | — | — | — | — | — | — | — | — | — | bal. |
| 4 | 1.53 | 0.15 | — | — | — | — | — | — | — | — | — | bal. |
| 5 | 3.57 | — | 0.20 | 0.15 | 0.10 | — | — | — | — | — | — | bal. |
| 6 | 6.44 | — | — | — | — | — | — | 0.30 | 0.10 | — | — | bal. |
| 7 | 0.54 | — | — | — | — | — | — | — | — | 0.05 | 0.34 | bal. |
| 8 | 4.83 | 0.03 | — | — | — | — | 0.10 | — | — | 0.21 | 0.47 | bal. |
| 9 | 7.36 | 0.13 | — | — | — | — | 0.10 | — | — | 0.06 | 0.31 | bal. |
| 10 | 5.12 | — | 0.17 | 0.15 | — | 0.03 | — | 0.10 | 0.11 | 0.18 | 0.35 | bal. |
| Comparison | | | | | | | | | | | | |
| 11 | 8.52 | — | — | — | — | — | — | — | — | 0.04 | 0.33 | bal. |
| 12 | — | 1.12 | — | — | — | — | 0.01 | — | — | 0.06 | 0.65 | bal. |
| 13 | — | — | 0.21 | — | — | — | 0.01 | 2.48 | — | 0.11 | 0.31 | bal. |

(Note)
Bal. stands for "balance".

Material alloys having the compositions shown in Table 1, wherein specimens No. 1 to No. 10 contain elements in the ranges specified in accordance with the present invention, and No. 11 to No. 13 contain elements out of the ranges.

Each material alloy was molded into a billet having a diameter of 152.4 mm, and the billet was homogenized at 600° C. for 15 hours. Then the billet was extruded into a pipe having an outside diameter of 65.0 mm and an inside diameter of 58.0 mm at 500° C. After the pipe was cut to 300 mm, its surface was mechanically polished until it presented a mirror surface. In this way the number of blank drums corresponding to that of the material alloys were obtained.

Each blank drum was coated with an alumite layer of 5 μm thick. Then the drum was submerged in a solution of polyvinyl-carbazole/trinitrofluorene until a layer thereof formed on the first layer to thickness of 15 μm. Instead of the alumite layer an polyethylene layer of 1 μm thick can be used. The alumite layer was formed by an anodic oxidizing treatment with the use of an electrolytic sulfuric acid solution of 15 wt%, heated to 20±1° C., at a current density of 1.3 A/dm$^2$.

Examination was made to see how the surface potential and the dark attenuation of each drum changed with time, wherein the surface potential was assessed in terms of changes in the potential after the drum was electrically charged at +5.7 kV for 20 seconds, and the dark attenuation was assessed by the comparison between the surface potential and the potential after the drum was left in darkness for 20 seconds. In Table 2 the results are shown by the marks A, B, C and D:

TABLE 2

| Alloy | Insulation layer | S.P. | D.A. |
|---|---|---|---|
| 1 | polyethylene | B | B |
| 2 | polyethylene | A | A |
| 3 | alumite | B | B |
| 4 | alumite | A | A |
| 5 | polyethylene | A | A |
| 6 | polyethylene | B | B |
| 7 | alumite | B | B |
| 8 | alumite | A | A |
| 9 | polyethylene | B | B |
| 10 | polyethylene | A | A |
| 11 | polyethylene | B | B |
| 12 | alumite | C | B |

TABLE 2-continued

| Alloy | Insulation layer | S.P. | D.A. |
|---|---|---|---|
| 13 | alumite | D | C |

(Note)
(1) S.P. and D.A. stand for surface potential and dark atttenuation, respectively.
(2) Marks A, B, C and D indicate the amplitude of the secular changes in surface potential and dark attenuation of the drums, as follow:
A: negligible
B: fairly small
C: fairly large
D: considerably large It will be apprecaited from Table 2 that the drums in accordance with the present invention have relatively stable electric characteristics in terms of surface potential and dark attenuation.

We claim:

1. A photosensitive drum adapted for use in electronic copying machines and laser beam printers, the drum made of aluminum-based alloy and supporting a photosensitive receptor thereon, the aluminum-based alloy having a composition consisting essentially of 0.5 to 8.0% of Ni, the balance being substantially aluminum.

2. A photosensitive drum as set forth in claim 1, wherein the Ni content is in the range of 1.5 to 6.0%.

3. A photosensitive drum as set forth in claim 1, wherein the aluminum-based alloy further comprises one or more additives selected from a group of 0.05 to 1.5% of Mn, 0.05 to 1.0% of Cr, 0.05 to 0.5% of Zr, 0.5% or less of Ti, and 0.1% or less of B.

4. A photosensitive drum as set forth in claim 3, wherein the contents of Mn, Cr and Zr are in the range of 0.1 to 1.5%, 0.1 to 1.0%, and 0.1 to 0.5%, respectively.

5. A photosensitive drum as set forth in claim 1, wherein the aluminum-based alloy further comprises one or more additives selected from a group of 0.05 to 7.0% of Cu, 0.05 to 7.0% of Mg, 0.05 to 8.0% of Zn, 0.05 to 12.0% of Si, and 0.05 to 2.0% of Fe.

6. A photosensitive drum as set forth in claim 3, wherein the aluminum-based alloy further comprises one or more additives selected from a group of 0.05 to 7.0% of Cu, 0.05 to 7.0% of Mg, 0.05 to 8.0% of Zn, 0.05 to 12.0% of Si, and 0.05 to 2.0% of Fe.

7. A photosensitive drum as set forth in claim 5, wherein the contents of Cu, Mg, Zn, Si and Fe are in the range of 0.1 to 2.0%, 0.1 to 2.0%, 0.1 to 3.0%, 0.1 to 3.0%, and 0.1 to 1.5%, respectively.

8. A photosensitive drum as set forth in claim 6, wherein the contents of Cu, Mg, Zn, Si and Fe are in the range of 0.1 to 2.0%, 0.1 to 2.0%, 0.1 to 3.0%, 0.1 to 3.0%, and 0.1 to 1.5%, respectively.

* * * * *